United States Patent [19]

Herchenroeder et al.

[11] Patent Number: 4,671,931

[45] Date of Patent: Jun. 9, 1987

[54] NICKEL-CHROMIUM-IRON-ALUMINUM ALLOY

[76] Inventors: Robert B. Herchenroeder, 609 N. Korby, Kokomo, Ind. 46901; Krishna V. Rao, 3034 Matthew Dr., Kokomo, Ind. 46902

[21] Appl. No.: 609,394

[22] Filed: May 11, 1984

[51] Int. Cl.[4] ..... C22C 19/05

[52] U.S. Cl. ..... 420/445; 420/446; 420/447; 420/448; 420/449

[58] Field of Search ..... 420/445, 443, 446, 447, 420/448, 449; 148/410, 428

[56] References Cited

U.S. PATENT DOCUMENTS 2,460,590 2/1949 Lohr ..... 420/445

4,460,542 7/1984 Herchenroeder ..... 420/443

*Primary Examiner*—R. Dean

*Attorney, Agent, or Firm*—Joseph J. Phillips

[57] ABSTRACT

A yttrium-free, nickel-chromium-iron-aluminum alloy characterized by excellent oxidation resistance at very high temperatures. The alloy consists essentially of, by weight, from 14 to 18% chromium, from 4 to 6% aluminum, from 1.5 to 8% iron, up to 12% cobalt, up to 1% manganese, up to 1% molybdenum, up to 1% silicon, up to 0.25% carbon, up to 0.03% boron, up to 1% tungsten, up to 0.5% tantalum, up to 0.2% titanium, up to 0.5% hafnium, up to 0.2% zirconium, up to 0.2% rhenium, balance essentially nickel. The nickel plus the cobalt content is at least 66%.

16 Claims, No Drawings

NICKEL-CHROMIUM-IRON-ALUMINUM ALLOY

The present invention relates to a nickel-chromium-iron-aluminum alloy, and, in particular, to a yttrium-free, nickel-chromium-iron-aluminum alloy.

U.S. patent application Ser. No. 381,477, filed May 24, 1982 now U.S. Pat. No. 4,460,542 granted July 17, 1984, teaches a yttrium-bearing, nickel-chromium-iron-aluminum alloy characterized by excellent oxidation resistance at very high temperatures (temperatures greater than 2000° F. [1093° C.]). Yttrium, an expensive addition, is present in the alloy as it was deemed to be a significant contributor to the alloy's oxidation resistance.

The benefit of yttrium in promoting oxidation resistance for nickel-base alloys, such as that of Ser. No. 381,477, is discussed in many other references. These references include: U.S. Pat. Nos., 3,754,902; 4,312,682; a 1974 article entitled, "The Effect of Yttrium and Thorium on the Oxidation Behavior of Ni-Cr-Al Alloys", by A. Kumar, M. Nasrallah and D. L. Douglas, Oxidation of Metals, Vol. 8, No. 4; a 1975 Aerospace Research Laboratory Report (TR-75-0234) entitled, "Oxide Scale Adherence Mechanisms and the Effect of Yttrium Oxide Particles and Externally Applied Loads on the Oxidation of Ni-Cr-Al and Co-Cr-Al Alloys", by C. S. Giggins and F. S. Pettit; and a 1973 article entitled, "The Role of Yttrium in High Temperature Oxidation Behavior of Ni-Cr-Al Alloys", by I. Kvernes, Oxidation of Metals, Volume 6, No. 1. Yttrium is also present in the nickel-base alloy of U.S. Pat. No. 3,832,167.

Still other references disclose the benefit of yttrium in iron-base alloys. These references include: U.S. Pat. Nos. 3,017,265; 3,027,252; 3,754,898; and U.K. patent specification No. 1,575,038.

We have, contrary to the belief of all of those heretofore cited references, discovered that yttrium may not be a significant addition to nickel-chromium-aluminum alloys; if those alloys have from 1.5 to 8% iron. Through our discovery, we are able to produce an alloy characterized by excellent oxidation resistance at very high temperatures, and at a considerable savings in cost.

A yttrium-free, nickel-base alloy is disclosed in U.S. Pat. No. 2,515,185; a patent which was filed long before researchers attributed benefits to yttrium as they do today. Nevertheless, U.S. Pat. No. 2,515,185 discloses an alloy which is dissimilar to that of the present invention. U.S. Pat. No. 2,525,185 discloses an alloy designed to be age-hardenable, whereas the alloy of the present invention was designed to be oxidation-resistant. U.S. Pat. No. 2,515,185 claims an alloy having at least 0.25% titanium, an age hardening element. Titanium is, on the other hand, not a part of the present invention. It is not added to the present invention as is shown in the Table (column 2) of U.S. Pat. No. 2,515,185. Titanium stabilizes gamma prime, and in turn, lessens workability.

Another yttrium-free, nickel-base alloy is disclosed in U.S. Pat. No. 4,054,469. The alloy of U.S. Pat. No. 4,054,469 is a high aluminum (7–12%) alloy. The alloy of the present invention has, on the other hand, no more than 6% aluminum. The principal second phase of the alloy of U.S. Pat. No. 4,054,469 is an aligned Ni, Fe, Al body-centered-cubic phase. The principal second phase of the alloy of the present invention is a randomly disbursed face-centered-cubic phase of the $Ni_3AL$ type. Neither the alloy of U.S. Pat. No. 4,054,469 nor that of U.S. Pat. No. 2,515,185 is similar to the yttrium-free alloy of the present invention.

It is accordingly an object of the present invention to provide a yttrium-free, nickel-chromium-iron-aluminum alloy characterized by excellent oxidation resistance at very high temperatures and by its workability.

The alloy of the present invention consists essentially of, by weight, from 14 to 18% chromium, from 4 to 6% aluminum, from 1.5 to 8% iron, up to 12% cobalt, up to 1% manganese up to 1% molybdenum, up to 1% silicon, up to 0.25% carbon, up to 0.03% boron, up to 1% tungsten, up to 0.5% tantalum, up to 0.2% titanium, up to 0.5% hafnium, up to 0 2% zirconium up to 0.2% rhenium, balance essentially nickel. The nickel plus the cobalt content is at least 66%, and generally at least 71%. The preferred chromium content is from 15 to 17%. Cobalt should be below 2% as it tends to stabilize gamma prime. The preferred molybdenum plus tungsten content is less than 1%, and the preferred sum of tantalum, titanium, hafnium and rhenium is less than 0.2%, for similar reasons. Preferred maximum carbon and boron contents are respectively 0.1 and 0.015%. Preferred maximum manganese and silicon contents are respectively 0.8 and 0.2%.

Iron is present in an amount of from 1.5 to 8%, and preferably in an amount of from 2 to 6%. Controlled additions of iron have been found to improve the workability of the alloy without materially degrading its oxidation resistance. Iron has been found to beneficially reduce the effectiveness of the gamma prime precipitate as a hardening agent. At least 1.5%, and preferably at least 2%, is added for workability. No more than 8% is added so as to preserve the alloys oxidation resistance and high temperature strength. A modest but yet significant increase in yield strength is attributable to the presence of iron in the preferred range of from 2 to 6%. The iron content is preferably in accordance with the relationship, $Fe \geqq 3+4$ (% Al $-5$), when the aluminum content is at least 5%.

The alloy of the present invention is, at a considerable cost saving, devoid of yttrium. Although it is not known for sure why yttrium is not needed, it is hypothesized that iron modifies the alloys protective oxide scale in much the same way as does yttrium.

Aluminum is present in an amount of from 4 to 6%, and preferably in an amount of from 4.1 to 5.1%. At least 4%, and preferably at least 4.1%, is added for oxidation resistance. Respective maximum and preferred maximum levels of 6 and 5.1% are called for as increasing aluminum contents are accompanied by increasing amounts of gamma prime. An iron content of at least 3% is preferably called for when the aluminum content is 5% or more. Iron, as stated hereinabove, has been found to reduce the effectiveness of gamma prime as a hardening agent.

A zirconium range of from 0.005 to 0.2%, and generally from 0.005 to 0.1%, is desirable. Zirconium in conjunction with carbon forms carbides which are stable at very high temperatures. These carbides tend to pin grain boundaries and minimize grain growth.

The presence of iron, and in turn the improved workability of the alloy, makes the alloy particularly suitable for use in the manufacture of wrought articles. Its outstanding oxidation resistance renders it particularly suitable for use as hardware in ceramic kilns and heat treating furnaces.

The following examples are illustrative of several aspects of the invention.

Four alloys were vacuum melted, cast into electrodes and electroslag remelted into ingots. The chemistry of the ingots is set forth hereinbelow in Table I.

TABLE I

| | COMPOSITION (Wt. %) | | | | | | | | | | | | | | |
|---|---|---|---|---|---|---|---|---|---|---|---|---|---|---|---|
| Alloy | Cr | Al | B | C | Cb | Co | Fe | Mn | Mo | P | S | Si | W | Ni | Y |
| A | 16.16 | 4.29 | 0.002 | 0.034 | <0.05 | 0.01 | 2.62 | 0.17 | <0.05 | 0.005 | <0.002 | 0.13 | 0.1 | 76.25 | 0.007 |
| B | 15.94 | 4.45 | <0.002 | 0.02 | <0.05 | 0.23 | 2.59 | 0.2 | 0.1 | <0.005 | <0.002 | 0.1 | 0.1 | 76.13 | 0.0036 |
| C | 15.74 | 4.16 | <0.002 | 0.01 | <0.05 | <0.1 | 3.51 | 0.1 | <0.1 | 0.008 | <0.002 | 0.2 | <0.1 | 75.83 | NA/ND |
| D | 16.2 | 4.43 | <0.002 | <0.01 | <0.05 | <0.1 | 2.59 | 0.2 | <0.1 | <0.005 | <0.002 | <0.1 | <0.1 | 75.56 | NA/ND |

NA/ND — Not Added/Not Detectable

Static oxidation tests were conducted at 2100° F. (1149° C.) for 1008 hours to compare the oxidation resistance of the four alloys (Alloy A, B, C and D). Samples were placed in an electrically-heated tube furnace and exposed to an air flow (measured at ambient temperature) of 3 cubic feet per hour per square inch (13.2 liters per hour per square centimeter) of furnace cross section. The samples were cycled once a day (except during weekends) during which they were cooled to room temperature and examined.

The results of the tests appear hereinbelow in Table II.

TABLE II

STATIC OXIDATION DATA
1008 HOURS/2100° F. (1149° C.)

| | Metal Loss | | Total Oxide Penetration | |
|---|---|---|---|---|
| Alloy | mils/side | (microns/side) | mils/side | (microns/side) |
| A | 0.16 | (4.1) | 0.16 | (4.1) |
| B | 0.06 | (1.5) | 0.30 | (7.6) |
| C | 0.07 | (1.8) | 0.40 | (10.2) |
| D | 0.15 | (3.8) | 0.60 | (15.2) |

The results indicate that, for the test conditions employed, the yttrium-free alloys (Alloys C and D) exhibit essentially the same metal loss and total oxide penetration as the yttrium-containing alloys (Alloys A and B).

Additional static oxidation tests were conducted at 2200° F. (1204° C.) for 500 hours. The results of these tests appear hereinbelow in Table III.

TABLE III

STATIC OXIDATION DATA
500 hours/2200° F. (1204° C.)

| | Metal Loss | | Total Oxide Penetration | |
|---|---|---|---|---|
| Alloy | mils/side | (microns/side) | mils/side | (microns/side) |
| A | 0.236 | (6.0) | 0.774 | (19.7) |
| B | 0.28 | (7.1) | 1.42 | (36.1) |
| C | 0.155 | (3.9) | 1.04 | (26.4) |
| D | 0.22 | (5.6) | 0.74 | (18.8) |

The results indicate that for the test conditions employed, the yttrium-free alloys (Alloys C and D) exhibit essentially the same metal loss and total oxide penetration as the yttrium-containing alloys (Alloys A and B).

More severe oxidation tests were conducted at 2192° F. (1200° C.) for 200 hours. The samples were heated to 2192° F. (1200° C.) in approximately 2 minutes and held there for 28 minutes, and then cooled in approximately 1 minute to 662° F. (350° C.). This constitutes one 30 minute cycle. Samples were cooled to room temperature and examined every 50 cycles.

The results of the 2192° F. (1200° C.) tests appear hereinbelow in Table IV.

TABLE IV

STATIC OXIDATION DATA
200 hours/2192° F. (1200° C.)

| | Metal Loss | | Total Oxide Penetration | |
|---|---|---|---|---|
| Alloy | mils/side | (microns/side) | mils/side | (microns/side) |
| A | 0.42 | (10.7) | 2.15 | (54.6) |
| B | 0.30 | (7.6) | 1.21 | (30.7) |
| C | 0.37 | (9.4) | 1.87 | (47.5) |

The results indicate that for the test conditions employed, the yttrium-free alloy (Alloy C) exhibited essentially the same metal loss and total oxide penetration as the yttrium-containing alloys (Alloys A and B).

It will be apparent to those skilled in the art that the novel principles of the invention disclosed herein, in connection with specific examples thereof, will support various other modifications and applications of the same. It is accordingly desired that, in construing the breadth of the appended claims, they shall not be limited to the specific examples of the invention described herein.

We claim:

1. A yttrium-free high-temperature, oxidationresistant alloy consisting essentially of, by weight, from 14 to 18% chromium, from 1.5 to 8% iron 0.005 to 0.2% zirconium. 4.1 to 6% aluminum, up to 12% cobalt, up to 1% manganese, up to 1% molybdenum, up to 1% silicon, up to 0.25% carbon, up to 0.03% boron, up to 1% tungsten, up to 0.5% tantalum, up to 0.2% titanium, up to 0.5% hafnium, up to 0.2% zirconium, up to 0.2% rhenium, said nickel plus said cobalt being at least 66% and the balance essentially nickel plus normal impurities wherein yttrium is not added as an alloying element.

2. An alloy according to claim 1, having from 15 to 17% chromium.

3. An alloy according to claim 1, having from 4.1 to 5.1% aluminum.

4. An alloy according to claim 1, having from 2 to 6% iron.

5. An alloy according to claim 1, having up to 0.8% manganese.

6. An alloy according to claim 1, having up to 0.2% silicon.

7. An alloy according to claim 1, having up to 2% cobalt.

8. An alloy according to claim 1, having up to 0.1% carbon and up to 0.015% boron.

9. An alloy according to claim 1, having up to 1% of elements from the group consisting of molybdenum and tungsten.

10. An alloy according to claim 1, having up to 0.2% of elements from the group consisting of tantalum, titanium, hafnium and rhenium.

11. An alloy according to claim 1, having at least 5% aluminum and at least 3% iron.

12. An alloy according to claim 11, wherein said iron content is in accordance with the relationship $Fe \geqq 3+4$ (% Al−5).

13. An alloy according to claim 1, having a nickel plus cobalt content of at least 71%.

14. An alloy according to claim 1, in wrought form.

15. An article for use as hardware in ceramic kilns, made from the alloy of claim 1.

16. An article for use as hardware in heat treating furnaces, made from the alloy of claim 1.

* * * * *